US008146507B2

(12) United States Patent
Hess

(10) Patent No.: US 8,146,507 B2
(45) Date of Patent: Apr. 3, 2012

(54) LASER-WELDED CRANE RAIL FOR SUSPENDED CRABS

(75) Inventor: Wilfried Hess, Gaildorf (DE)

(73) Assignee: Konecranes Plc, Hyvinkaa (FI)

( * ) Notice: Subject to any disclaimer, the term of this patent is extended or adjusted under 35 U.S.C. 154(b) by 134 days.

(21) Appl. No.: 12/515,251

(22) PCT Filed: Nov. 8, 2007

(86) PCT No.: PCT/EP2007/009684

§ 371 (c)(1),
(2), (4) Date: Aug. 12, 2009

(87) PCT Pub. No.: WO2008/058669

PCT Pub. Date: May 22, 2008

(65) Prior Publication Data

US 2010/0107918 A1 May 6, 2010

(30) Foreign Application Priority Data

Nov. 17, 2006 (DE) ..... 10 2006 054 682

(51) Int. Cl.
*B61B 3/00* (2006.01)

(52) U.S. Cl. ..... 104/93; 104/89; 104/106; 104/107

(58) Field of Classification Search ..... 104/89, 104/92, 93, 95, 106, 107, 109, 111; 105/148, 105/150, 154

See application file for complete search history.

(56) References Cited

U.S. PATENT DOCUMENTS

| | | | | |
|---|---|---|---|---|
| 1,178,196 | A * | 4/1916 | Willard | 104/107 |
| 3,043,408 | A * | 7/1962 | Attwood | 52/842 |
| 3,987,877 | A * | 10/1976 | Bulanchuk | 191/23 A |
| 4,524,698 | A * | 6/1985 | Tourtellier et al. | 104/107 |
| 4,768,442 | A * | 9/1988 | Miller | 104/106 |
| 4,838,412 | A * | 6/1989 | Backman | 198/838 |
| 5,203,135 | A * | 4/1993 | Bastian | 52/848 |
| 5,392,987 | A * | 2/1995 | Ropers et al. | 238/10 E |
| 5,404,992 | A | 4/1995 | Robu et al. | |
| 5,443,151 | A * | 8/1995 | Taylor | 198/860.1 |
| 5,598,785 | A * | 2/1997 | Zaguroli, Jr. | 104/111 |
| 6,283,038 | B1 * | 9/2001 | Mattila | 104/89 |
| 6,324,989 | B1 * | 12/2001 | Taylor et al. | 104/93 |
| 6,807,791 | B2 * | 10/2004 | Herb | 52/846 |
| 7,464,574 | B2 * | 12/2008 | Durney et al. | 72/324 |
| 7,584,703 | B2 * | 9/2009 | Wallner | 104/106 |
| 7,603,952 | B2 * | 10/2009 | Vetesnik | 104/106 |
| 7,784,627 | B2 * | 8/2010 | Birkigt et al. | 212/315 |
| 7,856,930 | B2 * | 12/2010 | Zaguroli, Jr. | 105/29.1 |
| 2009/0101039 | A1 * | 4/2009 | Zaguroli, Jr. | 104/106 |
| 2010/0019055 | A1 * | 1/2010 | Hess | 238/175 |
| 2010/0107918 | A1 * | 5/2010 | Hess | 104/93 |
| 2010/0282120 | A1 * | 11/2010 | Micheletti | 104/106 |

FOREIGN PATENT DOCUMENTS

| | | | |
|---|---|---|---|
| DE | 2342777 | B1 | 12/1974 |
| DE | 3329328 | C2 | 2/1985 |
| DE | 4109052 | A1 | 9/1992 |
| DE | 4119868 | A1 | 12/1992 |

(Continued)

*Primary Examiner* — S. Joseph Morano
*Assistant Examiner* — Jason C Smith

(57) ABSTRACT

Disclosed is a crane rail made from a roll-formed steel sheet strip. Said crane rail altogether comprises a top flange and a bottom flange. A support flange that has a triangular cross-section is additionally embodied on the top flange. The edges of the steel strip are laser-welded to the web.

31 Claims, 3 Drawing Sheets

FOREIGN PATENT DOCUMENTS

| | | | |
|---|---|---|---|
| DE | 102005044565 | B3 | 2/2007 |
| EP | 0139915 | B1 | 5/1985 |
| EP | 1205420 | A1 | 5/2002 |
| FR | 657057 | | 5/1929 |
| FR | 2579640 | A2 | 10/1986 |

* cited by examiner

LASER-WELDED CRANE RAIL FOR SUSPENDED CRABS

CROSS-REFERENCE TO RELATED APPLICATIONS

This patent application is the national phase of PCT/EP2007/009684, filed Nov. 8, 2007, which claims the benefit of German Patent Application No. 102006054682.2, filed Nov. 17, 2006.

FIELD OF THE INVENTION

The present invention relates generally to crane rails for suspended crabs.

BACKGROUND OF THE INVENTION

Travel rails for suspended crabs are made from roll-formed sheet steel for cost and weight reasons. One example of such a travel rail is described in DE 41 19 868 A1. The rail forms a hollow bottom flange and a hollow top flange that are connected to one another by a web. The web is configured as a single piece with one-half of the hollow top flange and one-half of the hollow bottom flange situated thereunder. The other halves of the top flange and the bottom flange consist of two individual roll-formed sheets that are then correctly positioned and joined to the part containing the web. These parts are then welded together.

The welding costs are relatively high since, during the welding process, the parts must be correctly positioned and fixed in place by means of corresponding devices. Furthermore, the welding seams are located where there is a risk of welding distortions. It is particularly difficult to produce long, reliable MAG welding seams on relatively thin material. Due to its shape, the rail is also susceptible to bending during transport and has a low torsional rigidity.

OBJECTS AND SUMMARY OF THE INVENTION

In view of the foregoing, a general object of the present invention is to develop a rail with superior properties that can be manufactured more simply.

The inventive rail consists of a single piece of roll-formed steel strip such that the handling of several parts is eliminated. After the roll-forming of the single sheet steel strip, the bending of the complete rail is finished. Devices for holding together any other parts in the correct position are not required. The handling during the welding process is also simplified because it is not required to join any long parts that are susceptible to bending for the welding process.

In addition, the steel strip edges of the new travel rail are laser-welded. Very little heat is introduced during the laser welding process such that practically no welding distortion can occur. Laser-welded seams are furthermore very reliable with respect to their strength behavior. Laser-welded seams also can be reproduced very well.

Once completed, the roll-formed steel strip forms a crane rail with a hollow top flange, a hollow bottom flange, and an integrally connected support flange that extends above the center of the top flange.

The novel crane rail has a section modulus that is 15% higher than that of comparable crane rails with the same wall thickness. A starting material thickness between 1.5 mm and 4 mm should be sufficient for the intended applications.

Due to the design of the rail profile, the bottom flange may be free of welding seams. The bottom flange may have a rectangular cross-sectional profile, where the height may lie between 10 mm and 30 mm. The bottom flange may have a width between 50 mm and 80 mm. If the profile is configured in this manner, the top flange may be free of welding seams, which favorably affects the handling, as well as the subsequent stability.

The top flange may have a rectangular cross-sectional profile, where its width may lie between 80 mm and 150 mm and its height may lie between 50 mm and 100 mm. If the roll-formed profile is designed accordingly, the support flange may be free of welding seams.

For mounting purposes, it can be particularly advantageous for the support flange to have a triangular cross-sectional profile. The triangle can be an isosceles triangle, the base of which is directed upward. The support flange may have a height between 10 mm and 25 mm, as measured on the base of the triangle, and a height between 20 mm and 40 mm, as measured parallel to the height of the crane rail.

If designed according to the invention, the web that connects the top flange to the bottom flange may be largely realized with two layers. The laser welding seams preferably lie in regions, in which a low stress occurs during the subsequent use. It may also be advantageous if the web respectively consists of two layers in two strip-shaped regions that border the top flange and the bottom flange and only one layer in between. This creates space for welding the steel strip edges to the continuous section of the web to produce an integrally connected part, although the starting material featured two edges that were not connected to one another.

The width of the strips, in which the web respectively consists of two layers, may lie between 5 mm and 20 mm. The overall height of the web, measured between the upper side of the bottom flange and the underside of the top flange, may lie between 80 mm and 150 mm.

The laser welding seams that connect the strip edges of the starting material to the continuous section of the web may consist of a continuous laser welding seam or laser welding seam sections.

In order to mount accessories as they are occasionally required for craneways, it may be advantageous if the web contains openings, preferably dumbbell-shaped openings, the longitudinal axis of which is aligned perpendicular to the longitudinal axis of the travel rail.

In order to anchor the crane rail of the invention on the supporting structure, such as the building roof, it is possible to utilize clamps with two jaws that are screwed together. The jaws engage with and positively hold the support flange. Each jaw preferably features a flange that extends parallel to the triangular cross section of the support flange; i.e., when the clamp is assembled, the carrying flanges obliquely converge and form a point that is directed downward in the direction of the travel rail. The carrying flange is connected to a holding flange by means of a rear section. The two holding flanges of the jaws lie in a common plane when the clamp is mounted.

In order to additionally connect the clamp to the remainder of the support structure, it is possible to use a bracket with a straight rear section, on the ends of which two lateral sides project upwardly. The bracket is inserted between the carrying flange and the support flange of the rail with the rear section and transmits the occurring forces from the travel rail to the support structure in a more positive fashion.

Other objects and advantages of the invention will become apparent upon reading the following detailed description and upon reference to the drawings.

The following description of the drawings clarifies features that assist in an understanding the invention. It should be obvious that numerous modifications are possible. Insofar as the drawings supplement the description of the preferred embodiments, other details that are not described can be deduced from the drawings by a person skilled in the art. The attached drawings are not necessarily true to scale. Certain areas may be exaggerated large to elucidate the certain details. Furthermore, the drawings are simplified and do not contain every possible detail of the illustrated embodiment.

Figure 1:
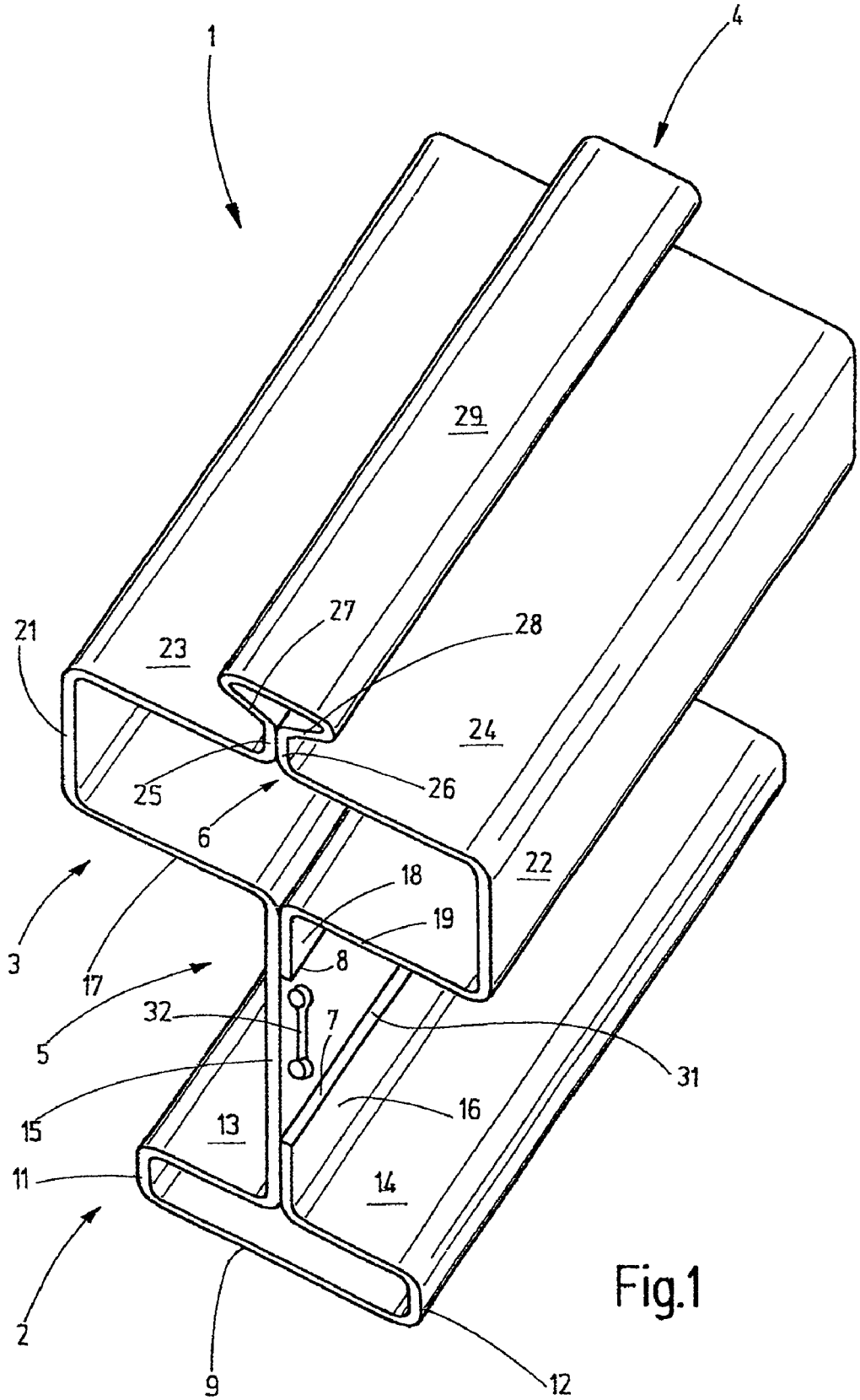
FIG. 1 is a perspective view of a section of an exemplary crane rail according to the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring to FIG. 1 of the drawings, a section of a crane rail 1 is shown in the operating position. The crane rail 1 is designed, in particular, in the form of a travel rail for suspended crabs, preferably suspended monorail crabs. The crane rail 1 features a bottom flange 2 in the form of a hollow profile, a top flange 3 that is also in the form of a hollow profile, as well as a support flange 4 that is again in the form of a hollow profile. The bottom flange 2 is connected to the top flange 3 by a web 5. The connection between the support flange 4 and the upper side of the top of flange 3 is produced with the aid of a web 6.

The crane rail 1 consists of an endless roll-formed sheet steel strip, the strip edges of which are designated by reference symbols 7 and 8. Due to the roll-forming, the hollow bottom flange 2 is includes a bottom wall 9 that transitions into side walls 11 and 12 at its edges. The bottom wall 9 is planar and extends horizontally in the operating state. The two side walls 11 and 12 are bent perpendicularly upward from the bottom wall 9. On their upper ends, the two side walls 11 and 12 respectively transition into flanges 13 and 14 that represent the upper side of the bottom flange 2. The wheels of the suspended crab run on the flanges 13 and 14.

Each of the two flanges 13 and 14 has a width that approximately corresponds to half the width of the bottom flange 2. On its edge that lies in the center of the crane rail 1, the flange 13 transitions into a strip 15 that forms part of the web 5 and extends up to the underside of the top flange 3. The flange 14, in contrast, transitions into a narrower web strip 16 that ends at the strip edge 7. The web strip 16 lies flatly against and abuts the web strip 15. The height of the web strip 16 is a fraction of the height of the web strip 15. The two web strips 15 and 16 define a joint that simultaneously forms the axis of symmetry of the crane rail 1 relative to the transverse direction. On its upper end, the web strip 15 transitions into a perpendicularly bent flange 17 that represents one half of the underside of the top flange 3.

The second strip edge 8 is located in the vicinity of the underside of the top flange 3 on the same side of the web strip 15, on which the web strip 16 lies, where the second strip edge borders a web strip 18 that lies flat against and abuts the web strip 15, like to the web strip 16.

On its upper end, the web strip 18 transitions into a flange 19. The flange 19 forms an extension of the flange 17 in the opposite direction relative to the vertical plane of symmetry. The two flanges 17 and 19 jointly form the underside of the top flange 3. The flange 17 and the flange 19 respectively transition into side walls 21 and 22 that extend parallel to one another and represent the side walls of the top flange 3.

The upper edges of the side walls 21 and 22 border horizontally extending flanges 23 and 24 that lie in a common plane and form the upper side of the top flange 3. On their edges or ends that point toward one another, the flanges 23 and 24 transition into two web strips 25 and 26 that also lie flat against and abut one another and form the upper web 6.

The two web strips 25 and 26 upwardly border two flanges 27 and 28 that include an angle <180° as shown in the figure. The two flanges 27 and 28 form the underside of the support flange 4 that converges to a point toward the web 6. On their outer edges, the two flanges 27 and 28 are integrally connected to one another by an upper side 29. The upper side 29 is the upper side of the support flange 4.

As mentioned above, the plane of symmetry of the crane rail 1 is the flat side of the web strip 15 that points toward the right (with reference to the drawings). The flanges 13 and 14 project by the same distance relative to this plane of symmetry. The flanges 17 and 19 and the flanges 23 and 24, respectively, also have the same width relative to this plane of symmetry, measured in the transverse direction of the crane rail 1. The two flanges 27 and 28 likewise leave the same extent in the transverse direction of the crane rail 1 relative to the aforementioned plane of symmetry.

The entire profile of crane rail 1 according to FIG. 1, with all its formed surface sections, is realized in one piece; i.e., there are no interruptions as one moves along the edge of the cross-sectional profile from strip edge 7 to the strip edge 8.

In order to achieve optimal stability, both strip edges 7 and 8, which consist of smooth front edges of the starting material, are laser-welded to the adjoining flat side of the web strip 15 in the inner corner region. A section in the laser welding seam is designated by reference symbol 31. The laser welding seams 31 that connect the strip edges 7 and 8 to the web strip 15 may consist of individual welding seam sections or one continuous welding seam.

The web may contain dumbbell-shaped openings 32, the longitudinal axis of which is aligned transverse to the longitudinal axis of crane rail 1.

The finally produced rail profile has a very high load carrying ability that lies 15% above that of comparable rails with the same material thickness.

The following dimensions can be very advantageous:

Material thickness: 1.5 mm to 4 mm

Height of bottom flange: 10 mm to 30 mm

Width of bottom flange: 50 mm to 80 mm

Width of top flange: 80 mm to 150 mm

Height of top flange: 40 mm to 100 mm

Height of support flange: 10 mm to 25 mm

Width of support flange: 20 mm to 10 mm

Height of web between top and bottom flange: 80 mm to 150 mm

Width of strips 16 and 18: 5 mm to 20 mm

Figure 2:
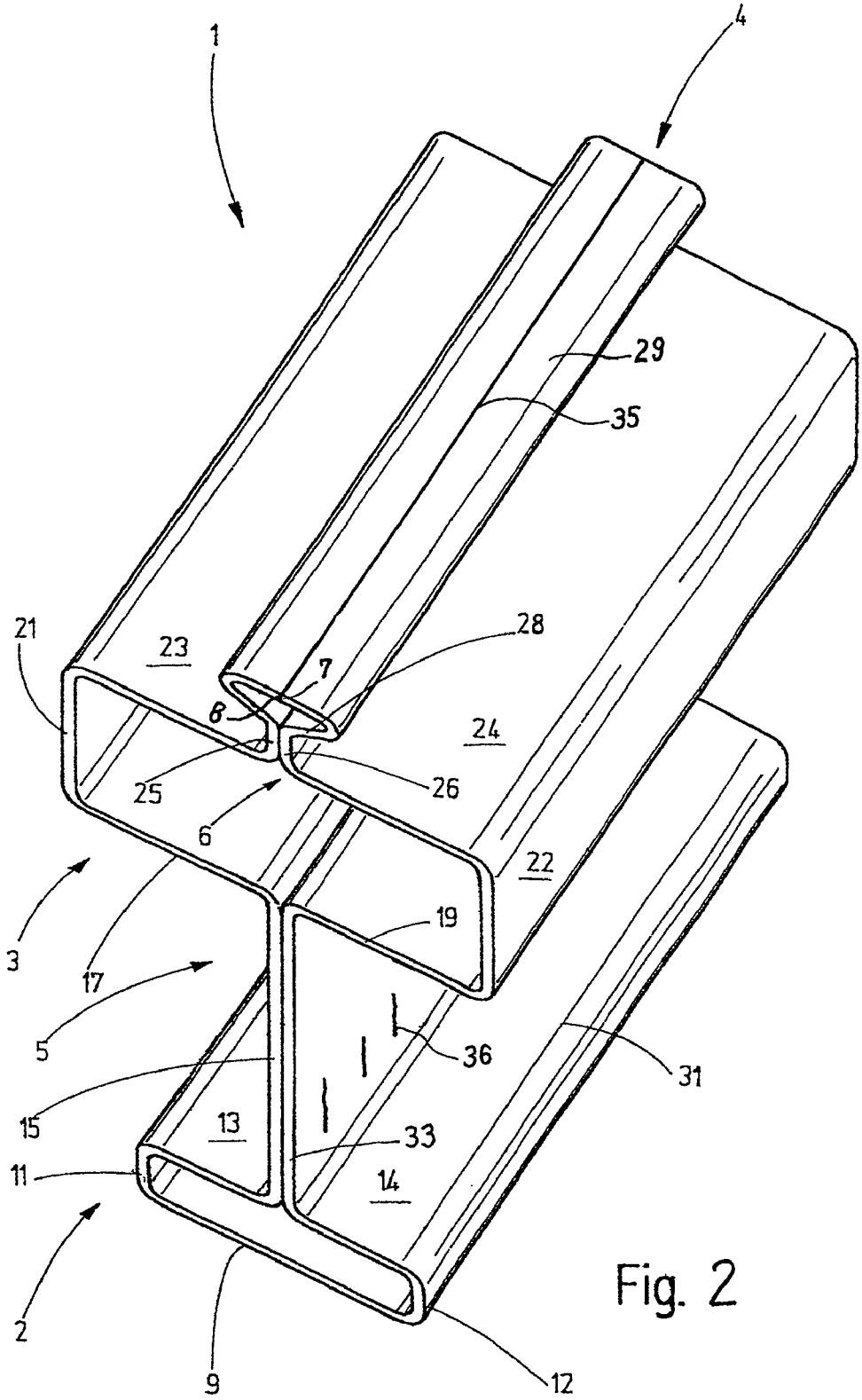
FIG. 2 is a perspective view of another exemplary embodiment of a crane rail according to the invention.

FIG. 2 shows another embodiment of the crane rail 1. The embodiment according to FIG. 2 is different from the embodiment according to FIG. 1 in that the two strip edges 7 and 8 no longer lie against the web flange 15, but rather in the region of the upper side 29 of the support flange 4.

FIG. 2 clearly shows that the basic profile is essentially identical, with the only distinction being that the flange 14 borders a web flange 33 that extends up to the flange 19. The two strip edges 7 and 8 lie in the center of the upper side 29 of the support flange 4 and abut one another at this location, as shown in FIG. 2. On the upper side 29, the two strip edges 7 and 8 are connected to one another by a continuous laser welding seam 35.

In order to increase the stability in the region of the bottom flange 2, the two web flanges 15 and 33 may be connected to one another by short laser welding seam sections 36 directly above the bottom flange 2. These welding seam sections 36 are produced with the aid of a laser and act like spot welds that integrally connect the two web flanges 15 and 33 to one another, instead of the laser welding seam 36. The short welding seam sections penetrate at least one of the two web flanges 15 and 33 and lie transverse to the longitudinal direction of the travel rail 1 as shown in FIG. 2. Due to the penetration, the material melts at the welding edges and integrally fuses with the other flange.

Figure 3:
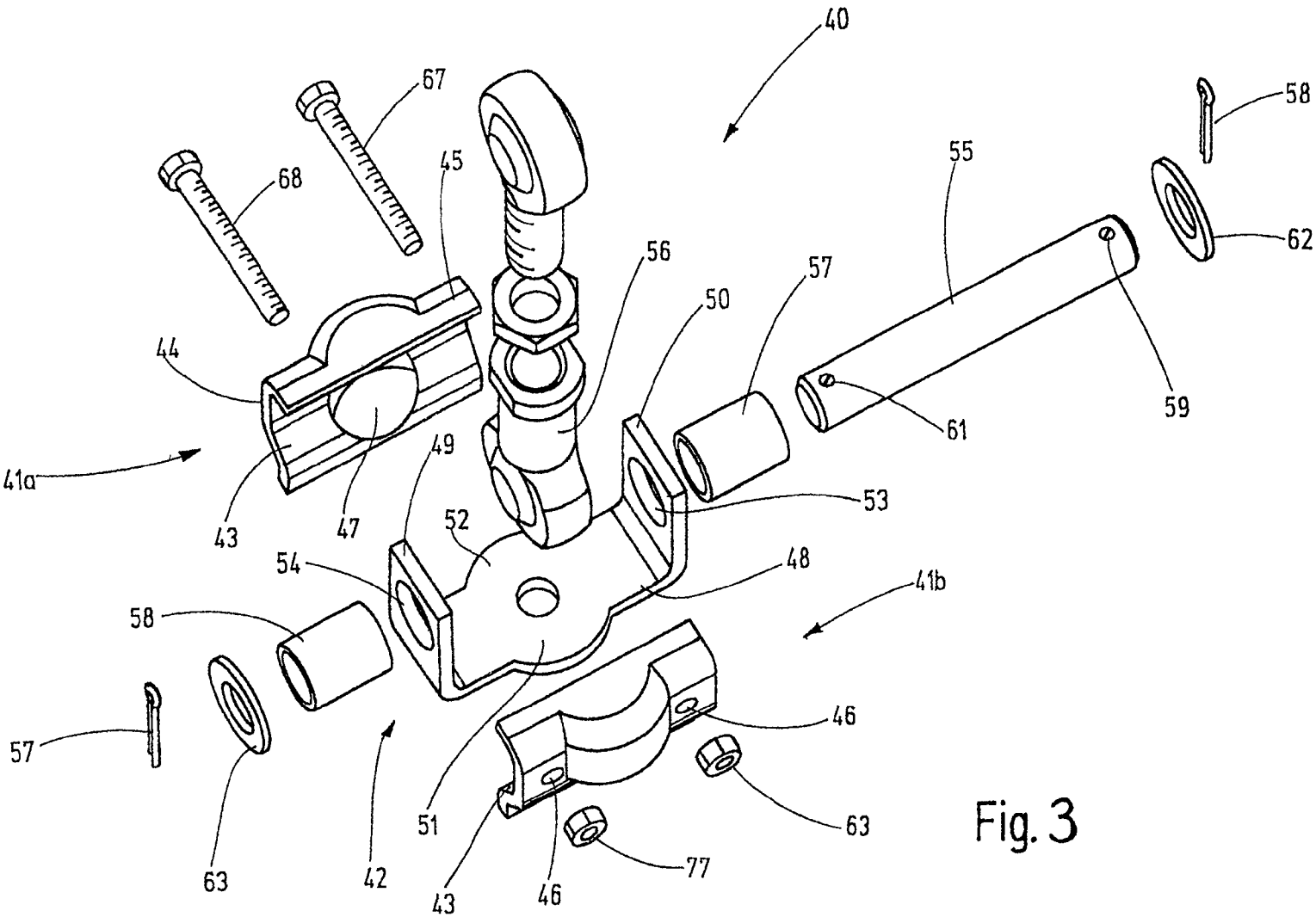
FIG. 3 is an exploded perspective view of a fitting for connecting the crane rail of FIG. 1 to a support structure.

FIG. 3 shows a perspective exploded view of a fitting 40 suitable for mounting the crane rail 1 on a support structure. The fitting 40 includes two clamping jaws 41*a* and 41*b*, as well as a support bracket 42. Since the two clamping jaws 41*a* and 41*b* are identical, only one of the two clamping jaws 41 is described in detail below.

The clamping jaws 41 consist of pressed components, and each clamping jaw 41 forms a clamping flange 43 that transitions into a web 44 on its outer rear side in the operative state, where said web again finally borders a horizontal carrying flange 45. The angle of the clamping flange 43 is chosen such that the clamping flange 43 flatly abuts the respective flange 27 or 28 of the support flange 4 in the operating state.

The clamping jaw contains a depression 46 in the form of a cylindrical segment approximately in the center relative to its length, wherein said depression is realized in the web 44, as well as in the oblique part of the clamping flange 43. The carrying flange 45 features a corresponding outward bulge in the form of a segment of a circle at this location. Except for this depression 46, each clamping jaw 41 has a constant profile cross section over its length. The web 44 contains bores 47 on either sides of the depression 46. The support bracket 42 is composed of a rear section 48, as well as two lateral sides 49 and 50. The lateral sides 49 and 50 perpendicularly project upwardly from the rear section 48.

The rear section 48 contains projections 51 and 52 in the form of segments of a circle on both sides, wherein these projections correspond to the depressions 46 with the form of cylindrical segments. Mutually aligned bores 53 and 54 extend through both lateral sides 49 and 50 and serve for accommodating a cylindrical bolt 55. The cylindrical bolt 55 makes it possible to connect a ball-and-socket joint 56 to the fitting 40. The ball-and-socket joint 56 is conventional in the field and therefore does not have to be described in detail.

Spacer bushings 57 and 58 are provided to center the ball-and-socket joint between the lateral sides 49 and 50. The cylindrical bolt 55 is axially secured with cotter pins 59 that extend through corresponding bores 61 in the cylindrical bolt 55 in the installed state. To prevent the bent cotter pins 59 from getting caught on any components, it would be possible to insert additional washers 62 and 63.

The fitting 40 is mounted on the crane rail as follows. The concave sides of the two clamping jaws 41*a* and the 41*b* are placed against the support flange 4. The clamping jaws engage underneath the flanges 27 and 28 of the support flange 4 with their clamping flanges 43. The support bracket 42 is inserted between the two clamping jaws 41*a* and 41*b* with the lateral sides 49 and 50 pointing upwards, such that the projections 51 and 52 in the form of segments of a circle lie in the depressions 46 in the form of cylindrical segments. Screws 67 and 68 are now inserted into bores 47 in the web 44 and secured with nuts 69 and 71. In the mounted state, the carrying flanges 45 abut one another with their front edges such that the tightened screws 67 and 68 can clamp the clamping flanges 63 against the support flange 4.

Due to the interaction between the projections 51, 52 in the form of segments of a circle and the depressions 46 in the form of cylindrical segments, the support bracket 42 is axially secured and blocked from carrying out an axial movement relative to the two clamping jaws 41*a* and 41*b*. The cylindrical bolt 55 is inserted after the connection between the fitting 40 and the crane rail 1 is produced, where the two spacer bushings 57 and 58 are inserted between the two lateral sides 49 and 50, and the ball-and-socket joint 56 is inserted between the spacer bushings. The washers 62 and 63 are then attached on the outer side and the cotter pins 59 are inserted into the bores 61 and correspondingly bent.

A crane rail is made from a roll-formed sheet steel strip. The crane rail comprises a top flange and a bottom flange, where a support flange of triangular cross section is additionally embodied on the top flange. The steel strip edges are laser-welded to the web.

The invention claimed is:

1. A crane rail for suspended crabs comprising:

a bottom flange in the form of a hollow chamber that extends a length of the crane rail with a constant cross section and forms travel surfaces for wheels of the suspended crabs on an upper side of the bottom flange;

a first web that is aligned vertically upward in a normal operating position and originates from a center of the bottom flange;

a top flange in the form of a hollow chamber that extends the length of the crane rail with a constant cross section and is connected to the bottom flange by the first web;

a second web that is aligned vertically upward in the normal operating position and originates from a center of the top flange; and a support flange from which the crane rail may be suspended in the form of a hollow chamber that extends the length of the crane rail with a constant cross section that is connected to the top flange by means of the second web;

said crane rail being configured in a single piece from a roll-formed sheet steel strip with two continuous longitudinal strip edges, said bottom flange, top flange, and support flange hollow chambers each defining closed chambers without any longitudinal opening from the respective chamber extending the length thereof, said strip edges being fixedly secured by welding to the sheet steel strip along or adjacent the strip edges, and at least two of said closed chamber defining flanges being free of seams defined by said strip edges.

2. The crane rail according to claim 1, wherein the sheet steel strip has a thickness between 1.5 mm and 4 mm.

3. The crane rail according to claim 1, wherein the bottom flange is free of welding seams.

4. The crane rail according to claim 1, wherein the bottom flange has a rectangular cross-sectional profile.

5. The crane rail according to claim 1, wherein the bottom flange has a height between 10 mm and 30 mm.

6. The crane rail according to claim 1, wherein the bottom flange has a width between 50 mm and 80 mm.

7. The crane rail according to claim 1, wherein the top flange is free of welding seams.

8. The crane rail according to claim 1, wherein the top flange has a rectangular cross-sectional profile.

9. The crane rail according to claim 1, wherein the top flange has a width between 80 mm and 150 mm.

10. The crane rail according to claim 1, wherein the top flange has a height between 40 mm and 100 mm.

11. The crane rail according to claim 1, wherein the support flange is free of welding seams.

12. The crane rail according to claim 1, wherein the support flange has a triangular cross-sectional profile with identical lateral sides.

13. The crane rail according to claim 1, wherein the support flange has a height between 10 mm and 25 mm.

14. The crane rail according to claim 1, wherein the support flange has a width between 20 mm and 40 mm.

15. The crane rail according to claim 1, wherein the strip edges lie in an upper side of the support flange and are integrally connected to one another by a welding seam.

16. The crane rail according to claim 15, wherein the second web comprises two continuous layers.

17. The crane rail according to claim 16, wherein the layers of the second web lie flat against each other.

18. The crane rail according to claim 16, wherein the first web comprises two layers and the layers of the first web are integrally connected to one another.

19. The crane rail according to claim 1, wherein the first web has a height between 80 mm and 150 mm.

20. The crane rail according to claim 1, wherein the first web is planar on a first side of the crane rail and the strip edges lie on a second side of the first web.

21. The crane rail according to claim 1, wherein the first web comprises first and second layers in strip-shaped regions, the first layer bordering on the top flange and the second layer bordering on the bottom flange, wherein the strip-shaped regions lie flat and are spaced apart from one another.

22. The crane rail according to claim 1, wherein the first web only consists of two layers between the adjacent top or bottom flange and the strip edge over a height between 5 mm and 20 mm.

23. The crane rail according to claim 1, wherein the first web contains dumbbell-shaped openings, wherein each of the dumbbell-shaped opening has a longitudinal axis that is perpendicular to a longitudinal axis of the crane rail.

24. A fitting for crane rails according to claim 1, the fitting comprising:

two clamping jaws featuring clamping flanges that converge to a point in a mounted state, the clamping flanges each having free ends that transition into a respective rear web, wherein the rear web connects each clamping flange to a carrying flange that lies in a common plane with the carrying flange of the other clamping jaw; and a U-shaped support bracket that has a rectangular shape in a side view and includes two parallel lateral sides, and a straight rear section that extends between the carrying flanges and the crane rail in the mounted state.

25. The fitting according to claim 24, wherein each rear web contains two through-bores, through which clamping screws pass.

26. The fitting according to claim 24, wherein each clamping jaw features a bulge in the form of a cylindrical segment, approximately in a center of a length of the respective clamping jaw.

27. The fitting according to claim 24, wherein the lateral sides of the support bracket contain bores for a locking pin and the fitting is connectable to a ball-and-socket joint by the locking pin.

28. The crane rail of claim 1 in which said strip edges are laser welded to the steel sheet strip.

29. A crane rail for suspended crabs comprising:

a bottom flange in the form of a hollow chamber that extends a length of the crane rail with a constant cross section and forms travel surfaces for wheels of the suspended crabs on an upper side of the bottom flange;

a first web that is aligned vertically upward in a normal operating position and originates from a center of the bottom flange;

a top flange in the form of a hollow chamber that extends the length of the crane rail with a constant cross section and is connected to the bottom flange by the first web;

a second web that is aligned vertically upward in the normal operating position and originates from a center of the top flange; and a support flange from which the crane rail may be suspended in the form of a hollow chamber that extends the length of the crane rail with a constant cross section that is connected to the top flange by means of the second web;

said crane rail being configured in a single piece from a roll-formed sheet steel strip with two continuous longitudinal strip edges, said bottom flange, top flange, and support flange hollow chambers each defining closed chambers without any longitudinal opening from the respective chamber extending the length thereof, said strip edges being fixedly secured by welding to the sheet steel strip, and said closed chamber defining bottom, top, and support flanges each being free of seams defined by said strip edges.

30. The crane rail of claim 29 in which said strip edges are fixedly secured along said first web.

31. A crane rail for suspended crabs comprising:

a bottom flange in the form of a hollow chamber that extends a length of the crane rail with a constant cross section and forms travel surfaces for wheels of the suspended crabs on an upper side of the bottom flange;

a first web that is aligned vertically upward in a normal operating position and originates from a center of the bottom flange;

a top flange in the form of a hollow chamber that extends the length of the crane rail with a constant cross section and is connected to the bottom flange by the first web;

a second web that is aligned vertically upward in the normal operating position and originates from a center of the top flange; and a support flange from which the crane rail may be suspended in the form of a hollow chamber that extends the length of the crane rail with a constant cross section that is connected to the top flange by means of the second web;

said crane rail being configured in a single piece from a roll-formed sheet steel strip with two continuous longitudinal strip edges, said bottom flange, top flange, and support flange hollow chambers each defining closed chambers without any longitudinal opening from the respective chamber extending the length thereof, said strip edges being fixedly secured by welding to the sheet steel strip, said web each being formed by two adjacent layers of said sheet steel strip free of strip edges of the sheet steel strip, said closed chamber defining top and bottom flanges being free of seams defined by said strip edges, and said strip edges each being welded together to define a welded seam that extends longitudinally parallel the center of the support flange.

* * * * *